US011347173B2

(12) United States Patent
Goto et al.

(10) Patent No.: US 11,347,173 B2
(45) Date of Patent: May 31, 2022

(54) RETRACTING DEVICE, ACCOMMODATING DEVICE, AND IMAGE FORMING APPARATUS

(71) Applicant: FUJIFILM Business Innovation Corp., Tokyo (JP)

(72) Inventors: Yasunobu Goto, Kanagawa (JP); Yoichi Yamakawa, Kanagawa (JP); Shumpei Nozawa, Kanagawa (JP); Shuhei Kobori, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 266 days.

(21) Appl. No.: 15/916,442

(22) Filed: Mar. 9, 2018

(65) Prior Publication Data

US 2019/0086852 A1 Mar. 21, 2019

(30) Foreign Application Priority Data

Sep. 19, 2017 (JP) ..... JP2017-179085

(51) Int. Cl.
*G03G 15/00* (2006.01)
*B41J 13/10* (2006.01)
(Continued)

(52) U.S. Cl.
CPC ..... *G03G 15/6511* (2013.01); *A47B 88/467* (2017.01); *B41J 13/106* (2013.01);
(Continued)

(58) Field of Classification Search
CPC ..... G03G 15/6511; G03G 15/6502; G03G 2215/00383; B65H 1/266; B65H 2402/44; B65H 2402/441; B65H 2402/5155
See application file for complete search history.

(56) References Cited

U.S. PATENT DOCUMENTS 8,408,535 B2 * 4/2013 Miki ..... G03G 15/6552 271/145
2006/0180996 A1 * 8/2006 Iwase ..... G03G 15/6502 271/162

(Continued)

FOREIGN PATENT DOCUMENTS

CN 101992957 A 3/2011
CN 105917276 A 8/2016

(Continued)

OTHER PUBLICATIONS

Office Action dated Jul. 13, 2021 in Japanese Application No. 2017-179085.

(Continued)

*Primary Examiner* — Manish S Shah
*Assistant Examiner* — Quang X Nguyen
(74) *Attorney, Agent, or Firm* — Sughrue Mion, PLLC

(57) ABSTRACT

A retracting device includes a housing that is disposed in or on an accommodating unit to be pulled out from an apparatus including a protrusion and that has a groove extending from a first position to a second position and having an opening formed at the first position, the first position corresponding to a position of the protrusion when the accommodating unit moving in a direction in which the accommodating unit is accommodated into the apparatus reaches a predetermined position and the second position corresponding to a position of the protrusion when the accommodating unit is accommodated in the apparatus, and a movable unit that is disposed in the housing and that moves, when the accommodating unit reaches the predetermined position and the protrusion enters the opening, while holding the protrusion to cause the protrusion to move along the groove and with respect to the housing toward the second position.

11 Claims, 8 Drawing Sheets

(51) Int. Cl.

| | |
|---|---|
| ***B65H 1/26*** | (2006.01) |
| ***G03G 21/16*** | (2006.01) |
| ***B65H 29/52*** | (2006.01) |
| ***A47B 88/467*** | (2017.01) |

(52) U.S. Cl.
CPC ..... *B65H 1/266* (2013.01); *B65H 29/52* (2013.01); *G03G 21/1647* (2013.01); *A47B 2210/17* (2013.01); *B65H 2402/441* (2013.01); *B65H 2405/11425* (2013.01); *B65H 2405/332* (2013.01); *B65H 2801/06* (2013.01); *G03G 2215/00392* (2013.01)

(56) References Cited

U.S. PATENT DOCUMENTS

| | | | | |
|---|---|---|---|---|
| 2016/0334745 | A1* | 11/2016 | Kwon | G03G 21/1695 |
| 2017/0277102 | A1* | 9/2017 | Takai | G03G 15/6502 |

FOREIGN PATENT DOCUMENTS

| | | | | |
|---|---|---|---|---|
| JP | 4-85220 | A | | 3/1992 |
| JP | 11-91963 | A | | 4/1999 |
| JP | 2015-209311 | A | | 11/2015 |
| JP | 2015-214403 | A | | 12/2015 |
| JP | 2016124699 | A | * | 7/2016 |
| JP | 2017-124909 | A | | 7/2017 |

OTHER PUBLICATIONS

Communication dated Nov. 3, 2021 from the China National Intellectual Property Administration in CN Application No. 201810413143.3.

Communication dated Mar. 31, 2022 from the China National Intellectual Property Administration in CN Application No. 201810413143.3.

* cited by examiner

RETRACTING DEVICE, ACCOMMODATING DEVICE, AND IMAGE FORMING APPARATUS

CROSS-REFERENCE TO RELATED APPLICATIONS

This application is based on and claims priority under 35 USC 119 from Japanese Patent Application No. 2017-179085 filed Sep. 19, 2017.

BACKGROUND

(i) Technical Field

The present invention relates to a retracting device, an accommodating device, and an image forming apparatus

(ii) Related Art

A function (retracting function) is known that enables an accommodating unit, when the accommodating unit is accommodated into a body apparatus, to be accommodated into the body apparatus without requiring a user to apply a force to the accommodating unit after the accommodating unit has been retracted to a predetermined position in the body apparatus by the user.

SUMMARY

According to an aspect of the invention, there is provided a retracting device including a housing that is disposed in or on an accommodating unit, the accommodating unit being configured to be pulled out from a body apparatus that includes a protrusion, and that has a groove extending from a first position to a second position and having an opening formed at the first position, the first position corresponding to a position of the protrusion when the accommodating unit moving in a direction in which the accommodating unit is accommodated into the body apparatus reaches a predetermined position and the second position corresponding to a position of the protrusion when the accommodating unit is accommodated in the body apparatus, and a movable unit that is disposed in the housing and that moves, when the accommodating unit reaches the predetermined position and the protrusion enters the opening, while holding the protrusion in such a manner as to cause the protrusion to move along the groove and with respect to the housing toward the second position.

BRIEF DESCRIPTION OF THE DRAWINGS

Exemplary embodiments of the present invention will be described in detail based on the following figures, where in.

DETAILED DESCRIPTION

Configuration

Figure 1A:
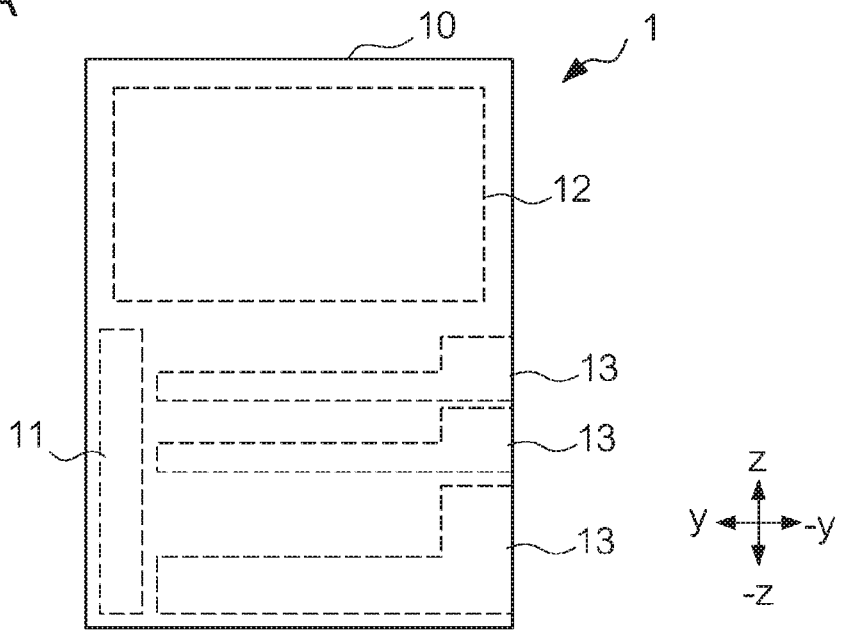
FIGS. 1A and 1B are side views illustrating an example of an image forming apparatus according to a first exemplary embodiment.
Figure 1B:
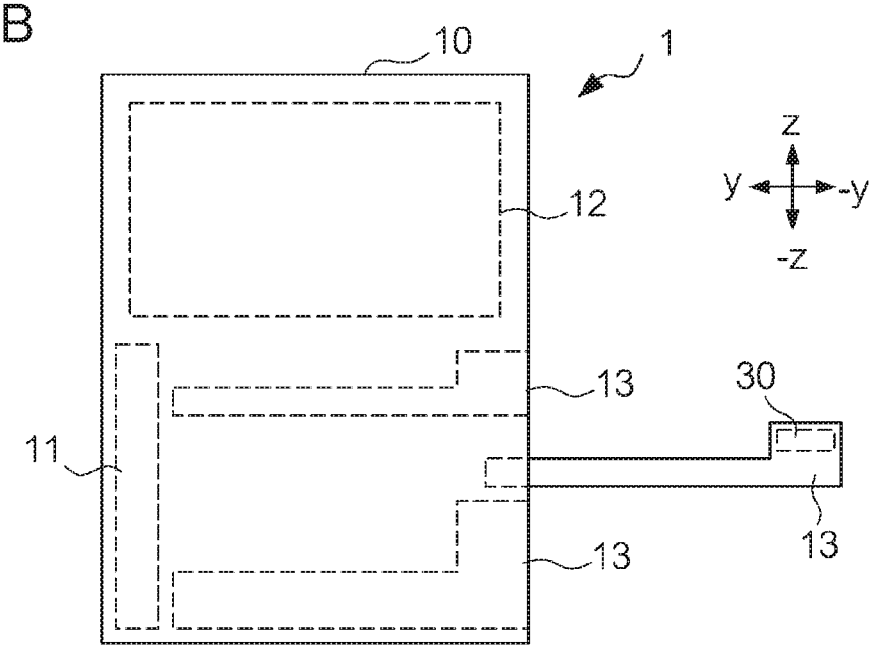
Figure 2:
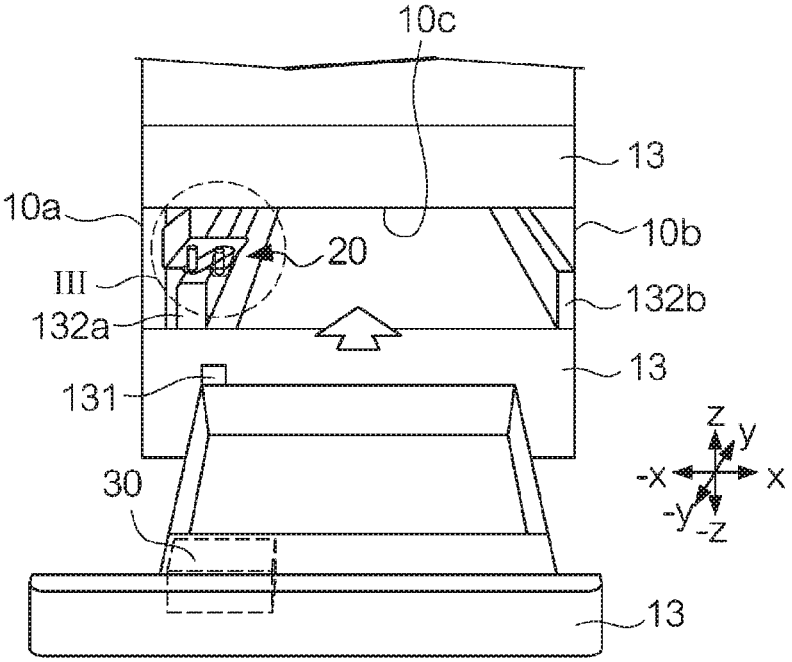
FIG. 2 is a front view illustrating the example of the image forming apparatus.

FIGS. 1A and 1B are side views illustrating an example of an image forming apparatus 1 according to a first exemplary embodiment. FIG. 2 is a front view illustrating the example of the image forming apparatus 1. The image forming apparatus 1 has a print function. The image forming apparatus 1 is, for example, a printer. The image forming apparatus 1, however, is not limited to a printer. The image forming apparatus 1 may be an apparatus that has, in addition to the print function, at least one of a copy function, a scan function, and a facsimile function.

As illustrated in FIG. 1, the image forming apparatus 1 includes a housing 10, a controller 11, an image forming unit 12, and plural sheet-feeding units 13. The housing 10 has a box shape and accommodates the controller 11, the image forming unit 12, and the sheet-feeding units 13. The housing 10 is an example of a first housing. The controller 11 controls each unit of the image forming apparatus 1. For example, the controller 11 includes a processor such as a central processing unit (CPU) and memory such as read only memory (ROM) and random access memory (RAM). The controller 11 performs various processing operations as a result of the processor running programs stored in the memory. The image forming unit 12 performs a process of forming an image onto a recording medium under control of the controller 11. For example, the image forming unit 12 employs an electrophotographic system and forms an image.

The sheet-feeding units 13 accommodate recording media and feed the recording media to the image forming unit 12. The recording media are, for example, sheets. The recording media, however, are not limited to sheets and may be any media as long as images are to be formed thereon. As illustrated in FIG. 2, positioning units 131 are each provided in one of the sheet-feeding units 13 so as to be positioned at an end of the sheet-feeding unit 13 in the direction of arrow −x in FIG. 2. Each of the positioning units 131 fixes the corresponding sheet-feeding unit 13 in place at a target position. This target position is, for example, a position at which the sheet-feeding unit 13 is capable of normally performing a sheet feeding operation. The positioning units 131 are, for example, protrusions. In the housing 10, receiving portions (not illustrated) are provided at positions each facing one of the positioning units 131. When one of the sheet-feeding units 13 is accommodated in the housing 10, the corresponding positioning unit 131 is fitted into a corresponding one of the receiving portions. As a result, the sheet-feeding unit 13 is fixed in place at the target position.

The housing 10 has a side surface 10*a* that forms an end surface of the housing 10 facing the direction of arrow −x in FIG. 2 and a side surface 10*b* that forms an end surface of the housing 10 facing the direction of arrow x in FIG. 2. Rails 132*a* and rails 132*b* are respectively disposed on the side surface 10*a* and the side surface 10*b* in such a manner as to be located inside the housing 10. The rails 132*a* and 132*b* extend in the direction of arrow −y in FIG. 2. Each of the sheet-feeding units 13 is slidably supported by one of the rails 132*a* and one of the rails 132*b*. Each of the sheet-feeding units 13 is configured to be operated by a user in such a manner as to move in the direction of arrow −y in FIG. 2 (hereinafter referred to as pull-out direction) and in the direction of arrow y in FIG. 2 (hereinafter referred to as retraction direction) between a closed position illustrated in FIG. 1A and an open position illustrated in FIG. 1B, inclusive. The closed position is the position of the sheet-feeding unit 13 when the sheet-feeding unit 13 is accommodated in the image forming apparatus 1. The open position is the position of the sheet-feeding unit 13 when the sheet-feeding unit 13 is pulled out from the image forming apparatus 1.

For example, when supplying the recording media to one of the sheet-feeding units 13, a user pulls out the sheet-feeding unit 13 from the front surface of the housing 10 in the pull-out direction. As a result, the sheet-feeding unit 13 is moved from the closed position illustrated in FIG. 1A to the open position illustrated in FIG. 1B. After the recording media have been supplied to the sheet-feeding unit 13, the user pushes the sheet-feeding unit 13 into the housing 10 in the retraction direction. As a result, the sheet-feeding unit 13 is moved from the open position illustrated in FIG. 1B to the closed position illustrated in FIG. 1A.

In this case, once the sheet-feeding unit 13 has reached a predetermined position between the open position and the closed position, the sheet-feeding unit 13 is retracted into the housing 10 by a corresponding one of retracting devices 30 and reaches the closed position. Consequently, a user does not need to keep pushing the sheet-feeding unit 13 until the sheet-feeding unit 13 reaches the closed position. The predetermined position is, for example, a position that is spaced away from the closed position by an amount equal to a retraction distance on a straight line connecting the open position and the closed position. The retraction distance may be, for example, in a range of about a few centimeters to about a few tens of centimeters. The function of retracting the sheet-feeding unit 13 is provided as a result of one of protruding portions 20 and the corresponding retracting device 30 cooperating with each other.

Figure 3:
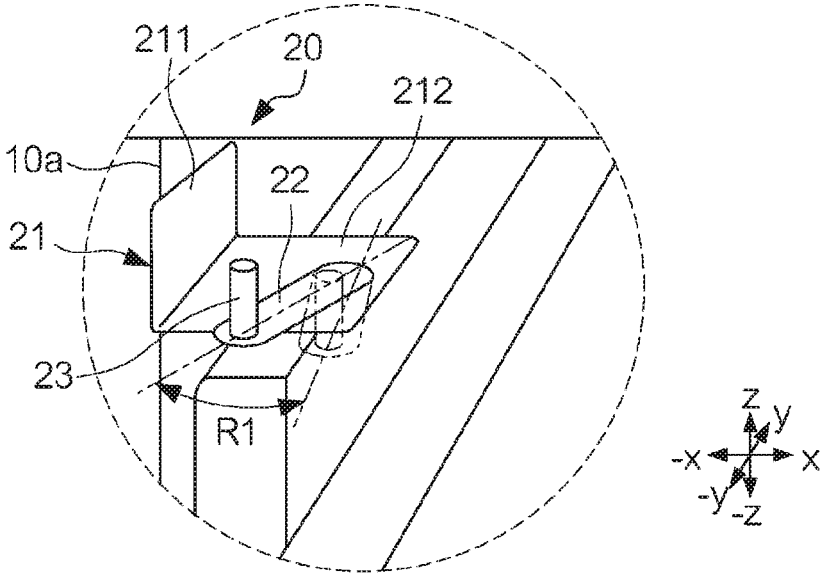
FIG. 3 is an enlarged view illustrating an example of a portion illustrated in FIG. 2.

FIG. 3 is an enlarged view illustrating an example of a portion III illustrated in FIG. 2. The housing 10 includes the protruding portions 20. Each of the protruding portions 20 is provided at a position corresponding to one of the retracting devices 30. As illustrated in FIG. 2, the housing 10 has cavities 10*c* into each of which one of the sheet-feeding units 13 is inserted. Each of the protruding portions 20 is disposed in one of the cavities 10*c* so as to be positioned at an end of the cavity 10*c* in the direction of arrow −x and the direction of arrow z in FIG. 2. Each of the protruding portions 20 serves as a fixed fulcrum when the corresponding sheet-feeding unit 13 is retracted. Each of the protruding portions 20 includes a support portion 21, an arm 22, and a protrusion 23.

Each of the support portions 21 has an L shape. Each of the support portions 21 has a first surface 211 fixed to the side surface 10*a* of the housing 10 in such a manner as to be located inside the housing 10 and a second surface 212 extending from toward the inside of the housing 10 the side surface 10*a* in the direction of arrow x in FIG. 3. Each of the arms 22 has a first end portion that is rotatably disposed on the second surface 212 of the corresponding support portion 21 and a second end portion to which the corresponding protrusion 23 is fixed. Each of the protrusions 23 has a cylindrical shape and protrudes from the corresponding arm 22 in the direction of arrow z in FIG. 3. Each of the protrusions 23 is supported by the corresponding arm 22 so as to be capable of swinging. For example, each of the protrusions 23 swings within a predetermined range R1 illustrated in FIG. 3.

The sheet-feeding units 13 are provided with the retracting devices 30. Each of the retracting devices 30 serves to cause the corresponding sheet-feeding unit 13 to retract into the housing 10 by using the corresponding protruding portion 20 as a fixed fulcrum. As illustrated in FIG. 1, each of the retracting devices 30 is disposed at a front end portion of the corresponding sheet-feeding unit 13 in the pull-out direction, that is, each of the retracting devices 30 is disposed on the pull-out direction side of the corresponding sheet-feeding unit 13. For example, there may be unoccupied spaces in the front end portions of the sheet-feeding units 13 in the pull-out direction. In this case, the retracting devices 30 may be disposed in the spaces (i.e., the retracting devices 30 may be built into the sheet-feeding units 13). In addition, each of the retracting devices 30 is disposed in or on the corresponding sheet-feeding unit 13 so as to be positioned at an end of the sheet-feeding unit 13 in the direction of arrow −x and the direction of arrow z in FIG. 2. The direction of arrow −x is a direction perpendicular to the pull-out direction. As described above, each of the positioning units 131 is disposed in the corresponding sheet-feeding unit 13 so as to be positioned at the end of the sheet-feeding unit 13 in the direction of arrow −x in FIG. 2. That is to say, the retracting devices 30 and the positioning units 131 are located on the same side in the direction of arrow −x in FIG. 2.

Figure 4:
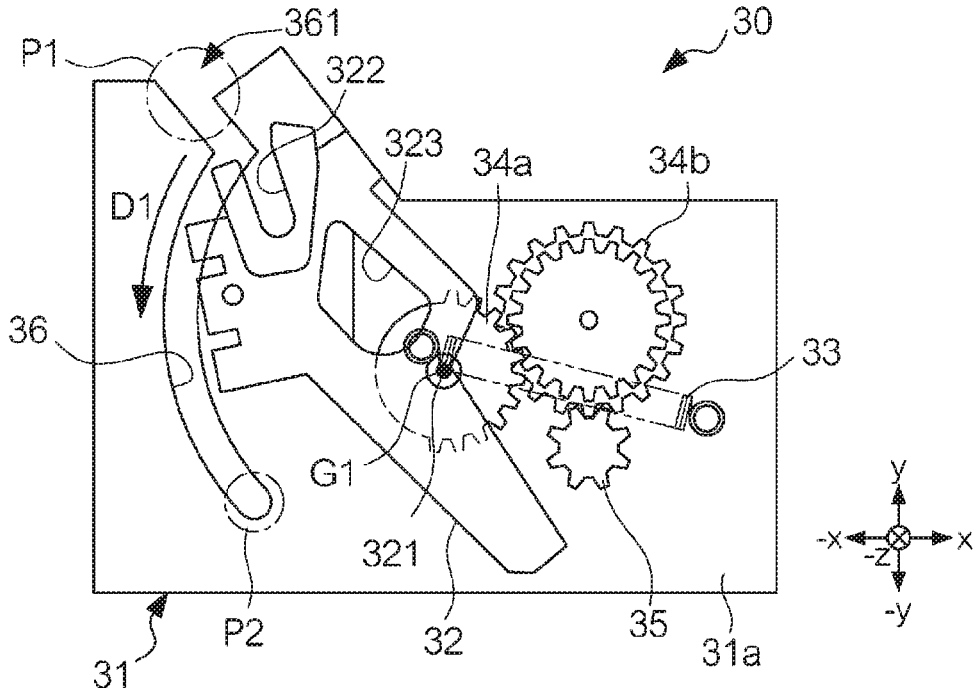
FIG. 4 is a plan view illustrating an example of a retracting device.

FIG. 4 is a plan view illustrating an example of one of the retracting devices 30. Note that, although the top surface of the retracting device 30 is actually covered with a lid, FIG. 4 illustrates a state in which the lid has been removed from the retracting device 30. The retracting device 30 includes a housing 31, a movable unit 32, an elastic member 33, transmission members 34*a* and 34*b*, and a damper 35.

The housing 31 has a box shape and accommodates the movable unit 32, the elastic member 33, the transmission members 34*a* and 34*b*, and the damper 35. In other words, the movable unit 32, the elastic member 33, the transmission members 34*a* and 34*b*, and the damper 35 are disposed in the housing 31. The housing 31 is an example of a second housing. At least a portion of the housing 31 is integrated with a housing of the corresponding sheet-feeding unit 13. For example, the lid of the housing 31 may be formed of the housing of the sheet-feeding unit 13. The housing 31 has a bottom surface 31*a* that forms an end surface of the housing 31 facing the direction of arrow −z in FIG. 4. Note that, in FIG. 4, the direction of arrow −z is a direction from the front side toward the back side as viewed in FIG. 4. A groove 36 is formed in the bottom surface 31*a*.

The groove 36 is, for example, a through groove and extends from a start position P1 to an end position P2. The start position P1 is an example of a first position, and the end position P2 is an example of a second position. At least a portion of the groove 36 has a curved shape. The start position P1 is a position corresponding to the position of the protrusion 23 when the sheet-feeding unit 13 reaches the predetermined position. The position corresponding to the position of the protrusion 23 is, for example, a position at which the protrusion 23 is present. In the housing 31, the start position P1 is located at an end in the direction of arrow y in FIG. 4. The end position P2 is a position corresponding to the position of the protrusion 23 when the sheet-feeding unit 13 reaches the closed position. The end position P2 is a position that is spaced away from the start position P1 in the direction of arrow −y in FIG. 4. The groove 36 has an opening 361 that is open in the direction of arrow y in FIG. 4 at the start position P1.

The movable unit 32 has a plate-like shape and is rotatably supported by a shaft 321. A cutout portion 322 is formed in a first end portion of the movable unit 32. When the sheet-feeding unit 13 is moved from the open position in the retraction direction and reaches the predetermined position, the protrusion 23 enters the opening 361. The cutout portion 322 has a shape corresponding to the protrusion 23. The cutout portion 322 receives and holds the protrusion 23, which has entered the opening 361. The protrusion 23 is inserted into the cutout portion 322 and fixed in place in the cutout portion 322.

The elastic member 33 applies a force that causes the movable unit 32 to rotate in a rotation direction D1 in FIG. 4 to the movable unit 32. The elastic member 33 is, for example, a spring. A first end of the elastic member 33 is fixed to the housing 31. A second end of the elastic member 33 is fixed to the movable unit 32. The movable unit 32 rotates, as a result of receiving the force applied by the elastic member 33, about the shaft 321 while the protrusion 23 is held in the cutout portion 322. As a result, the protrusion 23 moves toward the end position P2 along the groove 36. Note that, as described above, the protrusion 23 is fixed to the housing 10. Thus, the protrusion 23 does not actually move, and the housing 31 moves. In other words, the protrusion 23 moves with respect to the housing 31. The wording "the protrusion 23 moves with respect to the housing 31" refers to changing the position of the protrusion 23 with respect to the housing 31.

The movable unit 32 has the center of gravity G1 at a position where a moment in the rotation direction D1 in FIG. 4 is equal to or lower than a threshold. The moment is an amount representing the ability of the force that causes the movable unit 32 to rotate in the rotation direction D1. The moment is determined by using the distance from the shaft 321 to the center of gravity G1 and the magnitude of the force in the rotation direction D1 that acts on the center of gravity G1. For example, the moment is determined by calculating the vector product of the position vector from the shaft 321 to the center of gravity G1 and the magnitude of the force in the rotation direction D1 of the movable unit 32 generated at the center of gravity G1. The threshold is, for example, a value that makes it difficult for the movable unit 32 to rotate in the rotation direction D1. The threshold is, for example, zero. The threshold, however, is not limited to zero and may be a value greater than zero or may be a value less than zero as long as the value makes it difficult for the movable unit 32 to rotate in the rotation direction D1.

More specifically, the movable unit 32 is formed in a shape such that the center of gravity G1 is located at the position where the moment in the rotation direction D1 is equal to or lower than the threshold. For example, the movable unit 32 has a hole 323 formed between the shaft 321 and the cutout portion 322. As a result, the center of gravity G1 is located at a position that is superposed with the shaft 321. The position of the center of gravity G1 is an example of a target position.

Note that the rear edge of the first end portion of the movable unit 32 in the rotation direction D1 is in contact with the housing 31, and thus, in the state illustrated in FIG. 4, the movable unit 32 is prevented from rotating in a direction opposite to the rotation direction D1.

The transmission members 34*a* and 34*b* transmit a rotational force of the movable unit 32 to the damper 35. The transmission members 34*a* and 34*b* are, for example, gears. The transmission member 34*a* is connected to the movable unit 32. The transmission member 34*b* is connected to the transmission member 34*a* and the damper 35. The damper 35 reduces the speed at which the movable unit 32 rotates.

Operation

Figure 5A:
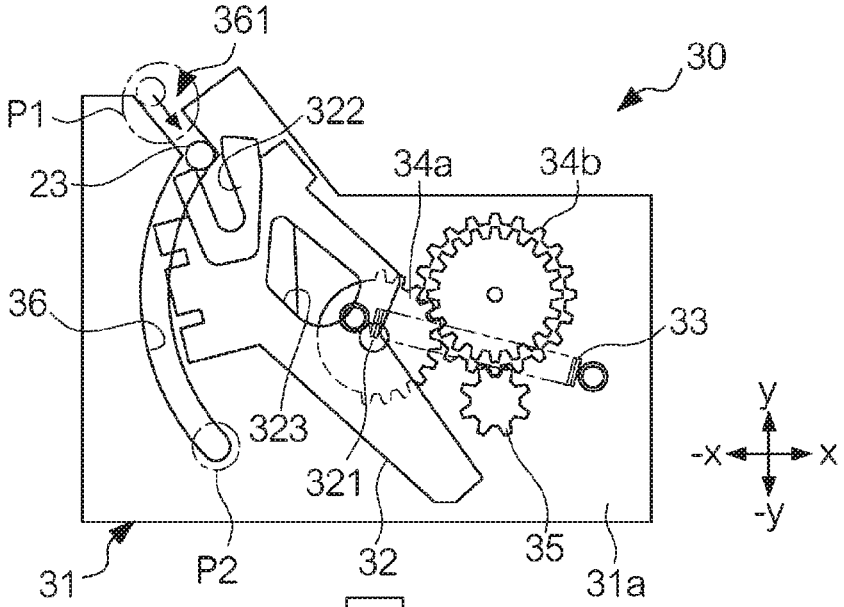
FIGS. 5A to 5C are diagrams illustrating an exemplary operation of the retracting device.
Figure 5B:
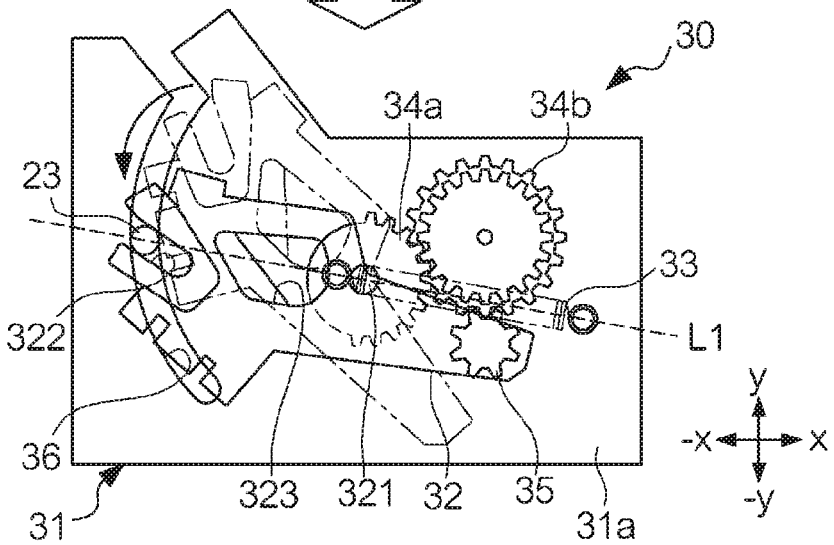
Figure 5C:
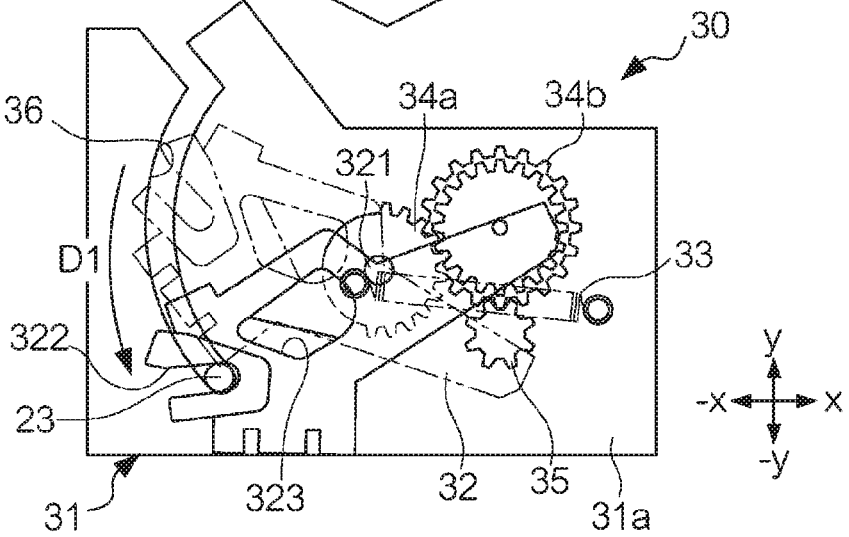

FIGS. 5A to 5C are diagrams illustrating an exemplary operation of one of the retracting devices 30. Here, assume the case where one of the sheet-feeding units 13 that has been pulled out by a user is accommodated into the housing 10. In this case, first, the user pushes the sheet-feeding unit 13 at the open position illustrated in FIG. 1A in the retraction direction. When the sheet-feeding unit 13 reaches the predetermined position, the corresponding protrusion 23 enters the opening 361 as illustrated in FIG. 5A. Then, the protrusion 23 is inserted into the cutout portion 322 and held in the cutout portion 322.

When the user pushes the sheet-feeding unit 13 deeper, the protrusion 23 moves along the groove 36. During the period when the protrusion 23 is moving from the start position P1 to a reference position that is indicated by a solid line in FIG. 5B, the elastic member 33 expands. The reference position is a position at which the first end portion of the movable unit 32 and the elastic member 33 are aligned on a straight line L1. Then, when the protrusion 23 has passed through the reference position, the elastic member 33 contracts. As a result, the movable unit 32 rotates in the rotation direction D1 in FIG. 5C while the protrusion 23 is held in the cutout portion 322. In this case, since the damper 35 reduces the speed at which the movable unit 32 rotates, the movable unit 32 slowly rotates.

Along with rotation of the movable unit 32, the protrusion 23 moves from the reference position toward the end position P2 along the groove 36. Note that, during the period when the protrusion 23 is moving from the start position P1 toward the end position P2, the protrusion 23 moves along the groove 36, which has a curved shape, within the predetermined range R1 illustrated in FIG. 3. As described above, the protrusion 23 is fixed to the housing 10. Accordingly, as a result of the protrusion 23 moving with respect to the housing 31, the sheet-feeding unit 13 is pulled in such a manner as to move in the retraction direction. Consequently, after the sheet-feeding unit 13 has reached the predetermined position, the sheet-feeding unit 13 is moved and accommodated into the housing 10 without the user pushing the sheet-feeding unit 13.

Next, assume the case where one of the sheet-feeding units 13 is pulled out by a user. As described above, each of the movable units 32 has the center of gravity G1 at the position where the moment in the rotation direction D1 is equal to or lower than the threshold. However, if the movable unit 32 has the center of gravity G1 at a position where the moment in the rotation direction D1 is greater than the threshold, there is a possibility that the following problems will occur.

Figure 6A:
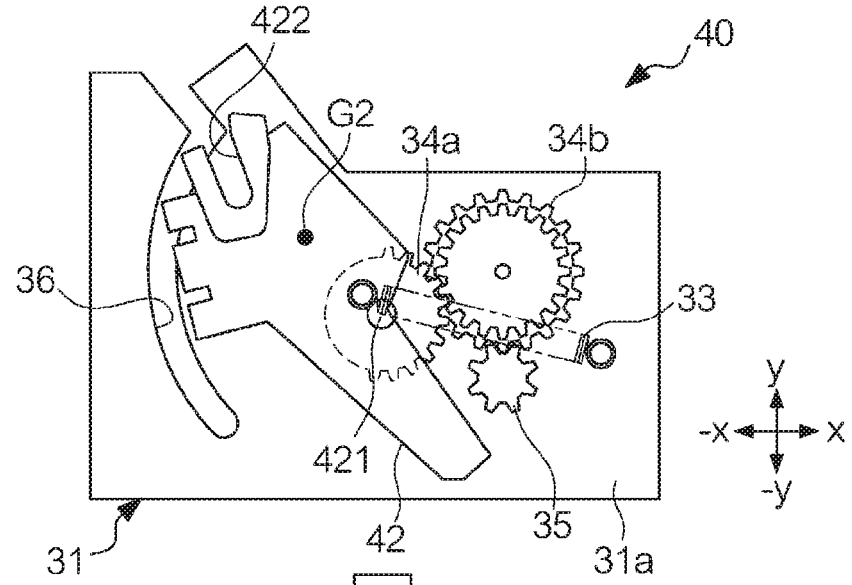
FIGS. 6A to 6C are diagrams illustrating an example of a retracting device according to a second exemplary embodiment.
Figure 6B:
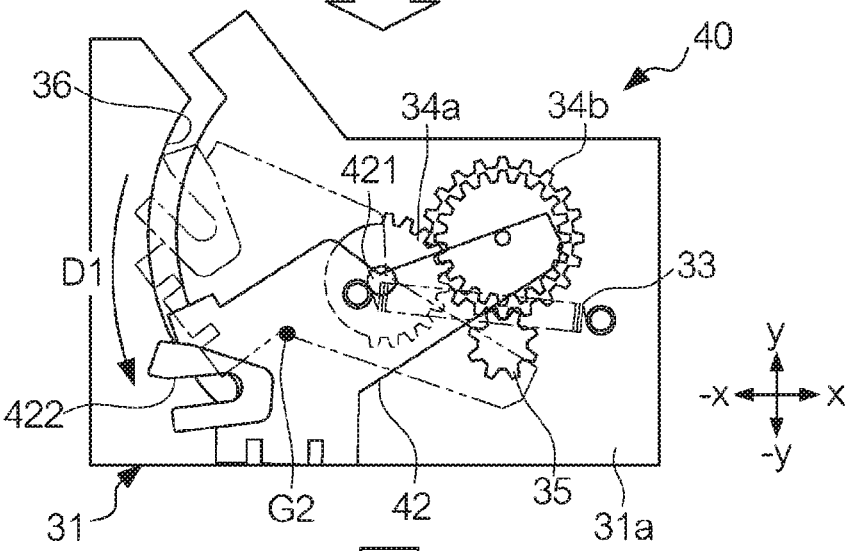
Figure 6C:
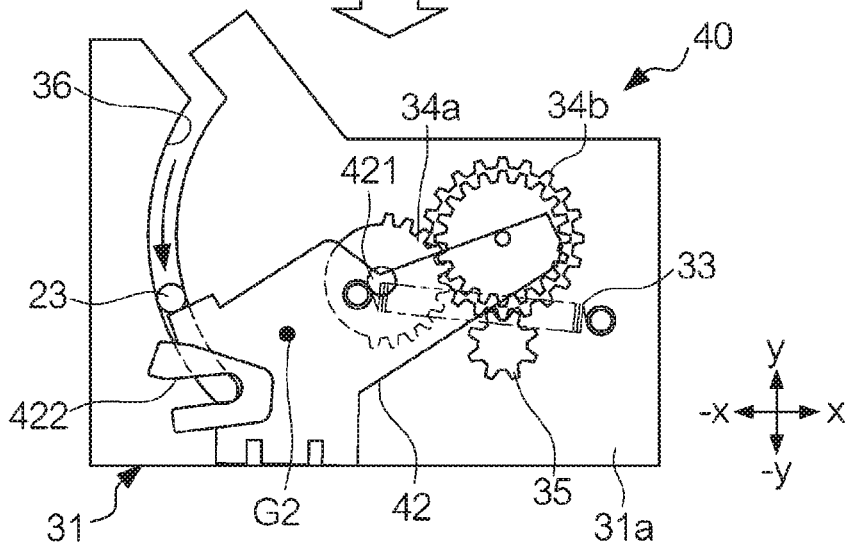

FIGS. 6A to 6C are diagrams illustrating an example of a retracting device 40 according to a second exemplary embodiment. The retracting device 40 has a configuration similar to that of each of the above-described retracting devices 30 according to the first exemplary embodiment except with regard to a movable unit 42. The retracting device 40 includes the movable unit 42 instead of the movable unit 32. The difference between the movable unit 42 and the movable unit 32 is that the hole 323 is not formed in the movable unit 42. In this case, the center of gravity G2 of the movable unit 42 is located between a shaft 421 and a cutout portion 422. The position of the center of gravity G2 is a position where the moment in the rotation direction D1 is greater than the threshold.

In the second exemplary embodiment, when a user vigorously pulls out the sheet-feeding unit 13, the vigorous pulling force may sometimes cause the movable unit 42 to rotate. In this case, even if the sheet-feeding unit 13 reaches the predetermined position, the protrusion 23 will not be held by the cutout portion 422, and thus, a retraction mechanism will not function. In addition, since the movable unit 42 has rotated, even if the protrusion 23 moves from the start position P1 along the groove 36 as a result of the user pushing the sheet-feeding unit 13, the protrusion 23 will be obstructed by the movable unit 42 before reaching the end position P2. In this case, the protrusion 23 is not capable of reaching the end position P2, and thus, the sheet-feeding unit 13 will not reach the closed position and will not be completely closed.

In contrast, as illustrated in FIG. 4, each of the movable units 32 according to the first exemplary embodiment has the center of gravity G1 at the position where the moment in the rotation direction D1 is equal to or lower than the threshold. Thus, even when one of the sheet-feeding units 13 is vigorously pulled out, the corresponding movable unit 32 is less likely to rotate in the rotation direction D1 than the movable unit 42 of the retracting device 40 according to the second exemplary embodiment. Therefore, unlike the retracting device 40 according to the second exemplary embodiment, disadvantages in that the retraction mechanism will not function and the sheet-feeding unit 13 will not be completely closed are unlikely to occur.

According to the above-described first exemplary embodiment, the housing 10 includes the protruding portions 20, and the sheet-feeding units 13 include the retracting devices 30. In this configuration, the retracting devices 30 do not need to be disposed in the housing 10. In general, each of the retracting devices 30 has a larger size than each of the protruding portions 20. Thus, by arranging the retracting devices 30 in or on the sheet-feeding units 13, a space in the housing 10 required for realizing a retracting function is reduced.

Here, each of the retracting devices 30 may be disposed in the housing of the corresponding sheet-feeding unit 13 (may be built into the corresponding sheet-feeding unit 13). In this case, the total volume of the retracting devices 30 and the sheet-feeding units 13 is reduced. In addition, since each of the retracting devices 30 is integrated with the housing of the corresponding sheet-feeding unit 13, the number of components forming the retracting device 30 is reduced.

Each of the movable units 32 has the center of gravity G1 at the position where the moment in the rotation direction D1 is equal to or lower than the threshold, that is, the center of gravity G1 of each of the movable units 32 is not located on the side on which the opening 361 is present when viewed from the shaft 321, and thus, the probability of the movable unit 32 rotating as a result of the corresponding sheet-feeding unit 13 being pulled out is reduced. In addition, the hole 323 is formed in the movable unit 32 so that the center of gravity G1 is located at the position where the moment in the rotation direction D1 of the movable unit 32 is equal to or lower than the threshold. According to this method, the position of the center of gravity G1 may be easily changed.

Modifications

The exemplary embodiments described above are examples of the present invention. The present invention is not limited to the above-described exemplary embodiments. For example, modifications may be made to the above-described exemplary embodiments as follows. In addition, two or more of the following modifications may be combined with each other.

Figure 7:
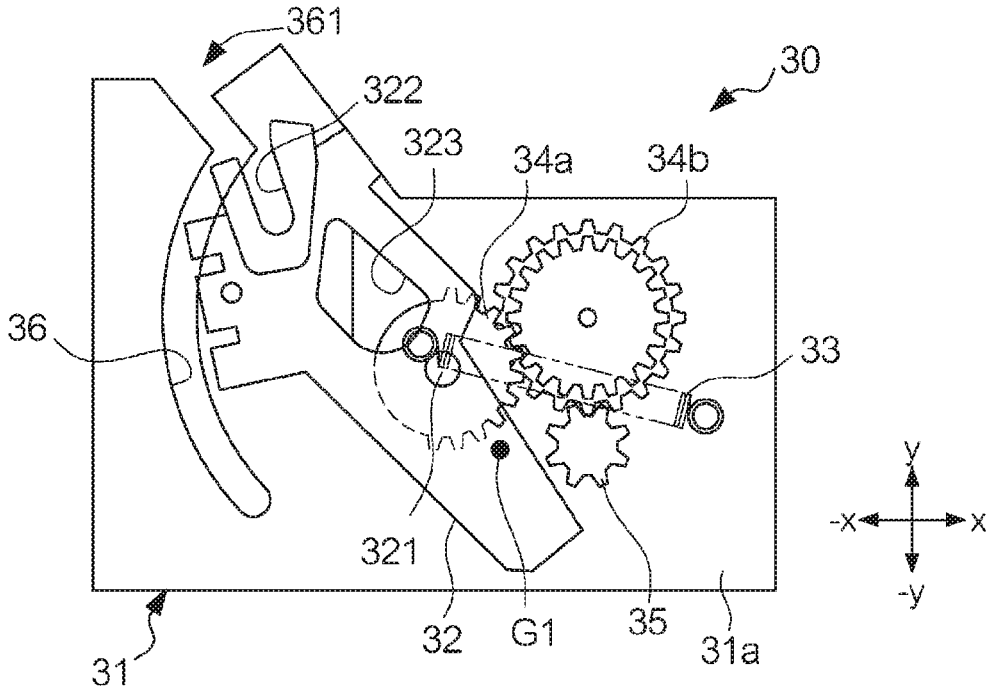
FIG. 7 is a diagram illustrating an example of the position of the center of gravity according to a first modification.

In the first exemplary embodiment, the center of gravity G1 of each of the movable units 32 is not limited to being located at a position that is superposed with the corresponding shaft 321. FIG. 7 is a diagram illustrating an example of the position of the center of gravity G1 according to a first modification. As illustrated in FIG. 7, the center of gravity G1 may be located between a second end portion of the movable unit 32 that is opposite to the first end portion of the movable unit 32, in which the cutout portion 322 is formed, and the shaft 321.

In the first exemplary embodiment, a method of changing the position of the center of gravity G1 of each of the movable units 32 is not limited to a method of forming the hole 323 in the movable unit 32. For example, the position of the center of gravity G1 of the movable unit 32 may be changed by changing the shape of the movable unit 32. In another example, the position of the center of gravity G1 may be changed by adding a weight to the movable unit 32. For example, the position of the center of gravity G1 may be changed by placing a weight between the second end portion of the movable unit 32 and the shaft 321. Alternatively, the position of the center of gravity G1 may be changed by changing the material of the movable unit 32. For example, the position of the center of gravity G1 may be changed by forming a portion between the second end portion of the movable unit 32 and the shaft 321 by using a material having a specific gravity greater than that of the material of a portion between the first end portion of the movable unit 32 and the shaft 321.

The retracting devices 30 are not limited to being arranged at the positions that are mentioned as examples in the above-described exemplary embodiments. For example, in the sheet-feeding units 13, the retracting devices 30 may be positioned at the end in the direction of arrow y in FIG. 1. In this case, also the protruding portions 20 are positioned at the end in the direction of arrow y in FIG. 1 in the housing 10. In another example, in sheet-feeding units 13, the retracting devices 30 may be positioned at the end in the direction of arrow x in FIG. 2. In this case, also the protruding portions 20 are positioned at the end in the direction of arrow x in FIG. 2 in the housing 10.

In the above-described exemplary embodiments, the housing 31 of each of the retracting devices 30 may be formed independently of the housing of the corresponding sheet-feeding unit 13. In this case, the retracting devices 30 may be retrofitted to the corresponding sheet-feeding units 13.

Figure 8:
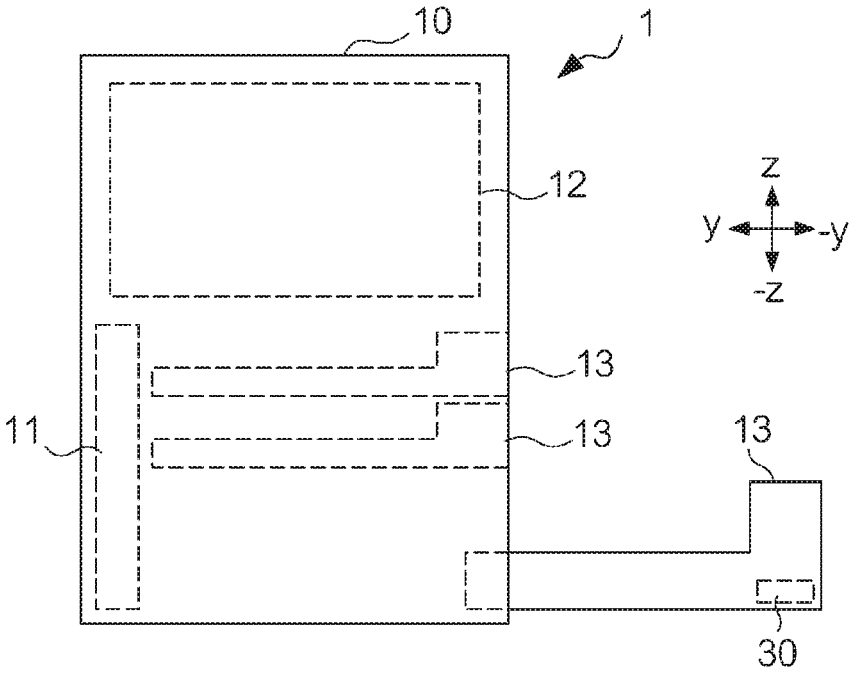
FIG. 8 is a diagram illustrating an example of a sheet-feeding unit according to a second modification.

In the above-described exemplary embodiments, in the case where one of the sheet-feeding units 13 has a large size, the corresponding retracting device 30 may be arranged at a position in the sheet-feeding unit 13 other than the end in the direction of arrow z in FIG. 1. The wording "the case where one of the sheet-feeding units 13 has a large size" refers to the case where the number of recording media to be accommodated in the sheet-feeding unit 13 is greater than a predetermined number. FIG. 8 is a diagram illustrating an example of one of the sheet-feeding units 13 according to a second modification. In the second modification, one of the retracting devices 30 is disposed in the corresponding sheet-feeding unit 13 so as to be positioned at an end of the sheet-feeding unit 13 in the direction of arrow −z in FIG. 8. In the case where one of the sheet-feeding units 13 has a large size, when an end portion of the sheet-feeding unit 13 in the direction of arrow z in FIG. 8 is pulled, there is a possibility that the sheet-feeding unit 13 will fall. According to the second embodiment, an end portion of the sheet-feeding unit 13 in the direction of arrow −z in FIG. 8 is to be pulled, and thus, the sheet-feeding unit 13 is less likely to fall compared with the case where the retracting device 30 is positioned at the end of the sheet-feeding unit 13 in the direction of arrow z in FIG. 8.

In the above-described exemplary embodiments, the movable units 32 are not limited to moving by rotating. For example, each of the movable units 32 may move by sliding in a direction in which the corresponding groove 36 extends. The wording "move by sliding" refers to moving the position of the entire movable unit 32 without changing the angle of the movable unit 32. In this case, for example, each of the movable units 32 is slidably supported by a rail. Each of the elastic members 33 applies a force that causes the corresponding movable unit 32 to slide and move along the corresponding groove 36 to the movable unit 32.

In the above-described exemplary embodiments, the retracting devices 30 are not limited to being provided in or on the sheet-feeding units 13. The retracting devices 30 may be provided in or on any accommodating units as long as the accommodating units are configured to be pulled out from a body apparatus. In addition, the body apparatus is not limited to the image forming apparatus 1. The body apparatus may be any apparatus as long as the apparatus accommodates an accommodating unit.

In the above-described exemplary embodiments, the retracting devices 30 may be provided as discrete devices. In addition, accommodating units such as the sheet-feeding units 13 may be provided as discrete accommodating devices.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device including a retracting device comprising:

a housing that is disposed in or on an accommodating unit, the accommodating unit being configured to be pulled out from a body apparatus that includes a protrusion, and that has a groove extending from a first position to a second position and having an opening formed at the first position, the first position corresponding to a position of the protrusion when the accommodating unit moving in a direction in which the accommodating unit is accommodated into the body apparatus reaches a predetermined position and the second position corresponding to a position of the protrusion when the accommodating unit is accommodated in the body apparatus;

a movable unit that is disposed in the housing and that moves, when the accommodating unit reaches the predetermined position and the protrusion enters the opening, while holding the protrusion in such a manner as to cause the protrusion to move along the groove and with respect to the housing toward the second position: and a rail for slidably supporting the accommodating unit disposed in the housing; and a protrusion which protrudes upwardly from the rail opposite a gravity direction, wherein the protrusion is swingably attached to the rail to swing parallel to an upper surface of the rail and a swinging range of the protrusion overlaps the rail when viewed in a gravity direction, wherein a supporting portion for the protrusion provides a gap between the protrusion and an upper part of the rail, the supporting portion overlaps the rail when viewed in a gravity direction, wherein the housing is built in a front end portion of the accommodating unit in a direction in which the accommodating unit is pulled out, wherein an upper portion of the accommodating unit is level with an upper part of the rail.

2. The image forming device according to claim 1, wherein the housing is built in the accommodating unit.

3. The image forming device according to claim 1, wherein the housing is formed integrally with the accommodating unit.

4. The image forming device according to claim 1, wherein a positioning unit that positions the accommodating unit is disposed at an end of the accommodating unit in a direction perpendicular to the direction in which the accommodating unit is pulled out, and wherein the housing is positioned at the end of the accommodating unit.

5. The image forming device according to claim 1, wherein the movable unit moves by rotating about a shaft.

6. The image forming device according to claim 5, wherein the center of gravity of the movable unit is not located on a side of the opening when viewed from the shaft.

7. The image forming device according to claim 1, wherein the movable unit moves in a direction in which the groove extends.

8. The image forming device according to claim 1, wherein the housing is configured to be fixed to the accommodating unit in manner to move with the accommodating unit as the accommodating unit is pulled out from the body apparatus.

9. The image forming device according to claim 1, further comprising a damper, configured to reduce a speed of rotation of the movable unit.

10. The image forming device according to claim 1, wherein the support portion has an L-shape.

11. The image forming device according to claim 1, wherein the support portion has a first surface fixed to a side surface of the housing so as to be located inside the housing, and a second surface extending from inside the housing to the side surface.

* * * * *